United States Patent [19]

Koehler

[11] Patent Number: 4,599,589

[45] Date of Patent: Jul. 8, 1986

[54] POLARIZED ELECTROMAGNETIC RELAY WITH A SINGLE-BREAK SWITCH

[75] Inventor: Gérard Koehler, Ville D'Avray, France

[73] Assignee: La Telemecanique Electrique, Nanterre, France

[21] Appl. No.: 708,422

[22] Filed: Mar. 5, 1985

[30] Foreign Application Priority Data

Mar. 14, 1984 [FR] France ..... 84 03910

[51] Int. Cl.[4] ..... H01H 63/02

[52] U.S. Cl. ..... 335/133; 335/187; 200/275

[58] Field of Search ..... 335/131, 133, 185, 187, 335/193; 200/275, 283, 284

[56] References Cited

U.S. PATENT DOCUMENTS

| | | | |
|---|---|---|---|
| 2,905,788 | 9/1959 | Harrison | 335/133 |
| 3,189,719 | 6/1965 | Holzer | 200/275 X |
| 3,260,828 | 7/1966 | Cartier | 220/275 X |
| 3,324,268 | 6/1967 | Adams | 200/288 |
| 4,494,099 | 1/1985 | Prijs | 335/133 X |

FOREIGN PATENT DOCUMENTS

| | | | |
|---|---|---|---|
| 2219315 | 11/1973 | Fed. Rep. of Germany | 335/133 |
| 82382 | 12/1963 | France | 335/133 |
| 2271654 | 12/1975 | France | 335/230 |
| 2466844 | 4/1981 | France | 335/230 |
| 2520152 | 7/1983 | France | 335/230 |
| 412619 | 7/1934 | United Kingdom | 335/133 |
| 594510 | 11/1947 | United Kingdom | 335/133 |
| 682667 | 11/1952 | United Kingdom | 335/133 |

*Primary Examiner*—George Harris

*Attorney, Agent, or Firm*—Young & Thompson

[57] ABSTRACT

A monostable polarized relay which has two permanent magnets and does not require any resilient restoring force is reduced to a minimum overall size while permitting a high current-carrying capacity of the relay contact. To this end, a flexible contact-strip is subdivided into two sinuous branches which extend in two different regions of the available space within the relay housing. The contact-carrying end of the strip is inserted in an actuating fork which is rigidly fixed to the moving armature and the other end of the strip is anchored to the base of the relay.

9 Claims, 6 Drawing Figures

POLARIZED ELECTROMAGNETIC RELAY WITH A SINGLE-BREAK SWITCH

This invention relates to a polarized electromagnetic relay with a single-break switch.

It will be understood that a single-break switch controlled by a relay of this type produces only one opening of the circuit in its open position in contrast to the more costly type of double-break switch comprising a moving member which is withdrawn from both ends of the circuit in the open position.

By polarized electromagnetic relay is meant a relay of the type described in French Pat. No. FR-A 2,271,654 or a relay in which the magnetic circuit is of the type described in French Pat. No. FR-A 2,466,844, and comprises a permanent magnet. The performances of these relays are such as to permit a reduction in overall size as well as high contact pressures. In a relay of this type, the element which carries the moving contact of the switch and provides it with an electrical connection must have a sufficient degree of stiffness in the case of monostable operation to return the moving armature from the "operating" position to the "rest" position. In accordance with French Pat. No. FR-A 2,520,152, a polarized relay can be made monostable by mounting a second magnet within an element of the magnetic circuit which is capable of moving with respect to the first magnet in order to be placed in series with the first in the "rest" position and in opposition to the first in the "operating" position.

The operation of the monostable relay is thus more reliable than when the restoring action is produced by elasticity of a resilient strip which carries the moving contact.

In this case it is an advantage to ensure that the element which carries the single-break moving contact and provides it with an electrical connection is as flexible as possible. If this condition is not satisfied, said element is liable to apply a force which, in some instances, cannot be overcome by the magnetic forces since they are fairly weak in the vicinity of the midpoint in the range of travel of the contact. Consideration could be given to the use of a braided-wire element but this type of material is not well-suited for practical application in miniature relays. A flexible contact-strip must have a minimum cross-sectional area which is governed by the design current-carrying capacity of the relay. A flexible strip of this type can have a high degree of flexibility only on condition that it is of sufficient length. A suitable length could be provided if the strip were to extend along the coil. With this arrangement, however, the cross-sectional area of the relay at right angles to the axis of the coil would be increased along the entire axial length of the relay. In consequence, the internal space of the relay casing thus made necessary could not be put to adequate use. Furthermore, a maximum width of 10 millimeters is imposed for certain applications.

The aim of the invention is thus to propose a polarized relay with a single-break switch and having a very small overall size without reducing the current-carrying capacity of the relay contacts.

The invention is thus directed to a polarized electromagnetic relay provided with at least one single-break switch housed within an internal space of very small volume. Said switch comprises a stationary contact carried by a support rigidly fixed to a base of the relay, and a moving contact carried by one end of a flexible strip which is anchored relative to the base in the vicinity of the other end of said strip. At a predetermined point between its anchoring location and the moving contact, said strip is attached to an actuating member which is rigidly fixed to the moving armature of the relay.

The distinctive feature of the relay in accordance with the invention lies in the fact that the contact-strip is subdivided into at least two branches between its anchoring location and the point of attachment aforesaid. At least one branch follows a non-rectilinear path in order to increase the flexibility of the strip between its anchoring location and its attachment location.

Each branch which is smaller in width than a single contact-strip is capable of following a long sinuous path which takes advantage of the internal recesses provided within the limited space thus allowed.

Thus the mean length of each branch is greater than would have been the case with a single branch of greater width. Nevertheless, the cross-sectional area for current flow is determined by the sum of cross-sectional areas of the two branches and can readily be made sufficient. Thus the switch can have a sufficiently flexible contact-strip and can nevertheless be housed within a very small space.

It is an acknowledged fact that U.S. Pat. No. US-A 3,324,268 describes a strip contact subdivided into two arms but the sole object of this arrangement is to enable the two arms to pass on each side of a central insulating support. Since the contact of this relay is of the double-break type, it is indeed not desirable to provide a contact-strip having a maximum degree of flexibility.

British Pat. No. GB-A 594,510 also describes a strip which is subdivided into two arms, but for the purpose of carrying on each arm a contact which is intended to be mechanically independent of the contact carried by the other arm, and not for the purpose of increasing the general flexibility of the strip.

Thus it is not suggested in any document of the prior art that, within a given space, each branch of a forked contact-strip can follow a longer path than a single strip having a width equal to the sum of the widths of both branches.

Preferably, the switch is housed at one of the axial extremities of a relay excitation coil. In this case, the relay can be housed within a parallelepipedal casing without increasing its transverse cross-sectional area. The sole effect produced by the presence of the switch is to increase the greatest length of the parallelepiped and no longer one of its widths, thus representing a much smaller increase in volume with respect to the incompressible basic volume occupied by the winding and the magnetic circuit.

Other features of the invention will be more apparent upon consideration of the following description and accompanying drawings, wherein.

Figure 1:
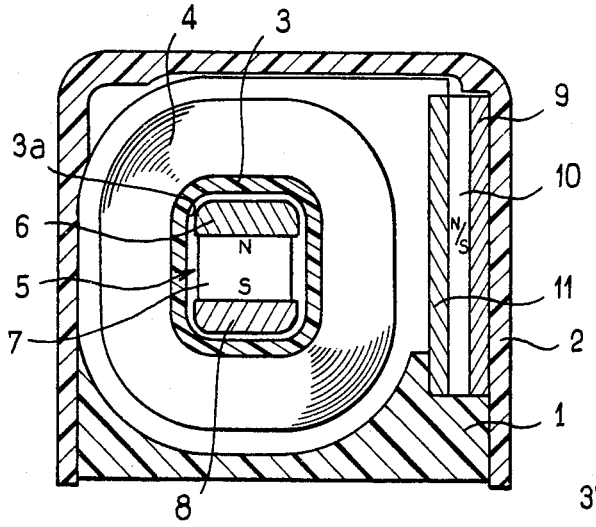
FIG. 1 is a view of a relay in accordance with the invention, this view being taken in transverse cross-section through the excitation coil and along line I—I of FIG. 4.

In the example illustrated in the drawings, the relay of the miniaturized type to be mounted on a printed circuit is housed within a parallelepipedal casing formed by a rectangular base 1 and a cover 2 which completes the parallelepiped. By way of example, a relay of this type measures 10×10×28 millimeters.

The electromagnetic section of the relay is of the type described in French Pat. No. FR-A 2,520,152. This section comprises a coil form 3, the axis of which extends along the length of the parallelepiped and on which is wound an excitation coil 4.

The coil form 3 comprises an axial passage 3*a* in which is slidably mounted a moving armature 5 formed of two pole-pieces 6 and 8 between which is interposed a permanent magnet 7. The contact faces located on the one hand between the pole-piece 6 and the magnet 7 and on the other hand between said magnet 7 and the pole-piece 8 are parallel to the axis of the coil form 3 and the axis of magnetization of the permanent magnet 7 is perpendicular to the direction of displacement.

Figure 4:
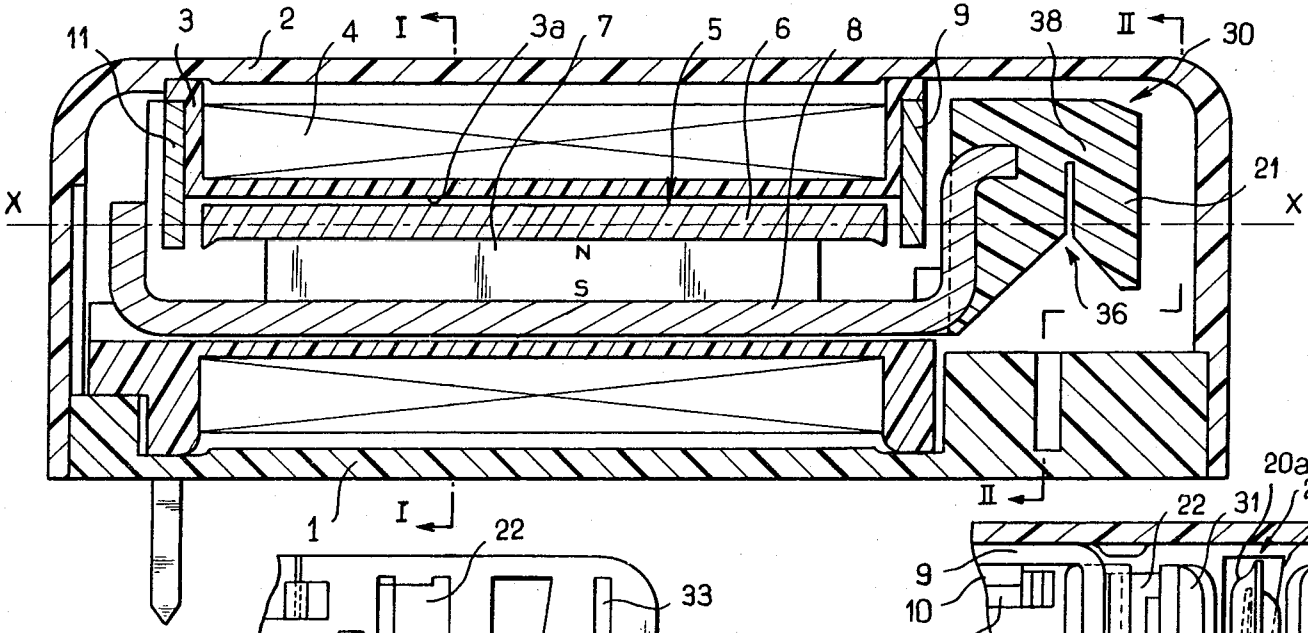
FIG. 4 is a view of the relay in axial cross-section along the plane IV—IV of FIG. 2, the switch having been omitted from this figure for the sake of enhanced clarity.
Figure 6:
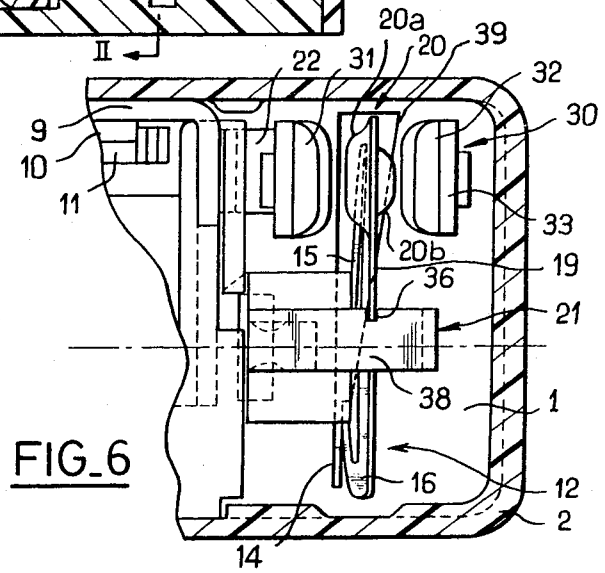
FIG. 6 is a top view of the relay in the switch region, the relay cover being shown in cross-section.

The relay further comprises a magnetic yoke made up of two half-yokes 9, 11 (as shown in FIGS. 1, 4 and 6) between which is interposed a permanent magnet 10. The axis of magnetization of the magnet 10 is perpendicular to the contact faces of each half-yoke 9 and 11, said contact faces being parallel to each other.

As shown in FIGS. 4 and 6, the half-yoke 9 is bent-back at one end so as to be placed opposite to one of the ends of the pole-piece 6 whilst the other half-yoke 11 is bent-back at one end so as to be located opposite to the other end of the pole-piece 6. The clearance between the pole-piece 6 and the bent-back ends of the half-yokes 9 and 11 determines the range of travel of the moving armature 5 (the armature is shown in FIG. 4 in a mid-travel position which is not stable in practice). The pole-piece 8 is of greater length than the pole-piece 6 and is bent-back at both axial end portions in order to come opposite to the end portions of the pole-piece 6 but on the other side of the half-yoke 9 or 11 which is present at each end. The distance between each end portion of the pole-piece 6 and the oppositely-facing end portion of the pole-piece 8 is equal to the range of travel of the moving armature 5 increased by the thickness of the interposed bent-back end portion of the half-yoke 9 or 11.

The electromagnetic operation of the relay will now be described:

In the rest position, the moving armature 5 tends to take up its end position towards the right-hand side of FIG. 4. In this position, the pole-piece 6 which is joined to the north pole of the magnet 7 is in contact with the half-yoke 9 joined to the south pole of the magnet 10 whilst the pole-piece 8 joined to the south pole of the magnet 7 is in contact with the half-yoke 11 joined to the north pole of the magnet 10.

When an electric current of predetermined intensity is applied to the excitation coil 4, electromagnetic forces are developed within the moving armature 5 which is thus displaced to its other end position. When current flow in the coil 4 is discontinued, the permanent magnets 7 and 10 cause the moving armature 5 to return to the first end position already mentioned.

The relay further comprises a switch 30 housed in one of the axial end portions of the coil 4 and more particularly in the end portion towards which the armature 5 is displaced in the rest position.

The switch 30 comprises two stationary contacts, namely a normally-open stationary contact 31 and a normally-closed stationary contact 32 which are located in oppositely-facing relation and between which is placed with a predetermined clearance space a moving contact 20 having two opposite contact faces 20*a* and 20*b* which are intended to cooperate respectively with the stationary contacts 31 and 32.

The three contacts 31, 20, 32 have substantially a common axis parallel to that of the coil 4 and are placed within the cover 2 in the vicinity of one of its longitudinal edges remote from the base 1. More specifically, the magnet 10 (shown in FIGS. 1 and 6) and the region of the two half-yokes 9 and 11 which cooperates with said magnet are mounted next to the coil 4 which is thus displaced laterally within the casing and the contacts 31, 20, 32 are located on the same side of the casing as the magnet 10.

The normally-open stationary contact 31 is carried by a conductive support 22, that end of said support which is remote from the contact 31 being designed in the form of a terminal connector-pin 23 which passes through the insulating base 1.

Similarly, the normally-closed stationary contact 32 is carried by a conductive support 33, that end of said support which is remote from the contact 32 being designed in the form of a terminal connector-pin (not shown) which passes through the insulating base 1.

Figure 5:
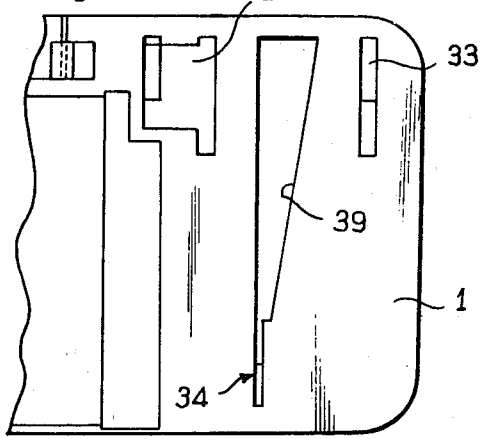
FIG. 5 is a fragmentary plan view of the internal face of the base of the relay shown in FIGS. 1, 2 and 4 in the region of the switch.

The contact 20 is carried by a flexible metallic strip 12, that end of said strip which is remote from the moving contact 20 being designed in the form of a terminal connector-pin 13 which passes through the insulating base 1. At a point just short of the connector-pin 13, the strip 12 has a region 14 which is inserted in a slot 34 (as shown in FIG. 5) formed in the base 1 at right angles to the axis of the coil and in a position of the casing which is diagonally opposite to the contacts 20, 31, 32.

The contact-strip 12 is folded back in the regions 13 and 14 in order to ensure that the double thickness thus provided has the effect of endowing the connector-pin 13 with enhanced rigidity and of increasing the width of the slot 34.

Figure 2:
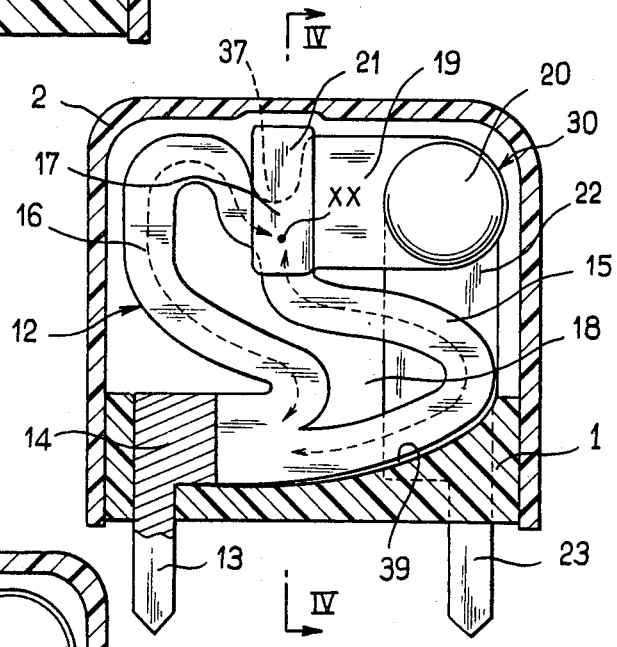
FIG. 2 is a view of the same relay in cross-section along line II—II of FIG. 4.

As shown in FIGS. 2 and 6, between the strip-anchoring region 14 and the moving contact 20, the strip 12 is engaged within the slot 36 (see also FIG. 4) of an actuating member or fork 21 of plastic material over-molded on the adjacent bent-back end portion of the pole-piece 8.

Between the anchoring region 14 and the region 17 which is engaged in the slot 36, the flexible strip 12 is subdivided into two branches 15 and 16 each having a width corresponding to one-half the width of the strip 12 in the region 14. The two branches 15 and 16 also have the same length and define an opening 18 between them. Said branches are joined together on the one hand in the vicinity of the region 14 and on the other hand within the slot 36 of the fork 21.

One of the branches 15 extends in a snaked-coil meander between the supports 22 and 33 beneath the contact 20 before returning towards the slot 36. The other branch 16 extends in a snaked-coil meander towards the longitudinal edge of the cover 2 opposite to the edge located next to the contacts 20, 31, 32 before returning towards the slot 36.

As shown in FIG. 2, the branch 16 extends in a return path towards the base 1 before being joined to the region 17 which is engaged in the slot 36. Thus, in the region which is engaged in the slot 36, the contact-strip 12 is provided with a notch 37 which leaves room for the web 38 (FIG. 4) of the fork 21.

With reference to FIG. 4, it will be apparent that the magnetic forces which produce displacements of the armature 5 are developed during operation in the region located at each end of the moving armature 5 between the ends of the pole-pieces 6 and 8. These two regions define an axis X—X along which the magnetic forces are exerted and which is parallel to the direction of translational displacement of the armature 5. The axis X—X passes substantially through the center of the region 17 of the contact-strip 12 which occupies the slot 36.

As shown in FIGS. 2 and 5, the base 1 has a hollowed-out portion 39, the shape of which as seen from above is that of a flattened triangle having a direction of extension substantially parallel to the width of the base 1 and the pointed end of which is joined to the slot 34.

When seen in transverse cross-section through the axis of the coil 4 (FIG. 2), it is apparent that the depth of the hollowed-out portion 39 is of maximum value in the vicinity of the slot 34 and decreases progressively to its other extremity while closely following the profile of the initial portion of the snaked-coil meander of the branch 15.

With further reference to FIG. 5, it is noted that, when seen from above, the hollowed-out portion 39 has a dissymmetrical shape which takes into account certain essential requirements in regard to positioning of the connector-pins 13, 23 and of the connector-pin (not shown) which is associated with the normally-closed contact 32 and in regard to the distance between the normally-open stationary contact 31 with respect to the half-yoke 9 which is bent-back on this side of the coil.

It is desirable to ensure that the flexible strip 12 is in the unstressed state or in other words does not tend to urge the contact 20 either in one direction or in the other when said contact 20 is located half-way between the stationary contacts 31 and 32. In fact, the magnetic forces are of relatively low value at this point of travel of the armature 5 and an elastic force exerted in either one direction or the other could prevent operation of the relay or produce a non-abrupt displacement of the moving contact-strip when the excitation voltage undergoes a progressive variation.

In spite of the above-mentioned displacement between the relative positions of the connector-pins such as the pins 13 and 23 and the relative positions of the contacts 31 and 32, the metallic strip 12 is sufficiently flexible to dispense with any need for adjustment by bending.

The branches 15 and 16 have substantially the same length and the same width. The width is such that, taking into account the thickness of the sheet metal employed, the sum of cross-sectional areas for current flow in the two branches is sufficient for the maximum value of current which it is desired to pass through the switch 30.

On that side of the region 17 which is remote from the branches 15 and 16, the flexible strip 12 has a region 19 which extends along a rectilinear path up to the end of the strip which carries the moving contact 20. Furthermore, the width of the region 19 exceeds the sum of widths of the branches 15 and 16. It is observed that the slot 36 is of greater depth on the side corresponding to the region 19 in order to accommodate not only the region 17 but also the initial portion of the region 19.

The operation and advantages of the relay described in the foregoing will now be explained.

As has been noted earlier, the monostable operation of the relay does not result from a restoring force exerted by the flexible strip 12 but from a particular structure of the magnetic circuit 5 to 11. It is desirable on the contrary to ensure that the strip 12 has the lowest possible rigidity between the anchoring region 14 and the region 17 which cooperates with the actuating fork 21. By virtue of the subdivision into two branches, each branch 15, 16 can have a length such as to possess a sufficient degree of flexibility for good operation of the relay. Furthermore, the arrangement shown in which the region 17 is centered on the axis X—X permits displacement of the moving armature 5 without frictional contact within the coil form 3. This arrangement is also conducive to good monostable operation of the relay.

Figure 3:
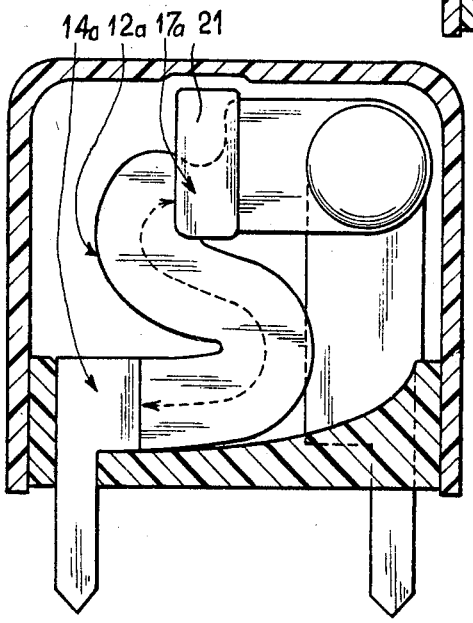
FIG. 3 is a view which is similar to FIG. 2 but relates to a hypothetical construction which serves to explain the advantages of the invention.

There is shown by way of comparison in FIG. 3 the substantially maximum length which it would have been possible to give to the flexible strip **12*a* between the anchoring region 14*a* and the region 17*a* which cooperates with the fork 21 if, in contrast to the invention, the strip 12***a* had not been subdivided into two branches. It could be considered possible to make the two meanders of the strip 12*a* even more sinuous in order to increase the length of its median line. In practice, however, this is impossible since the strip would no longer have the necessary width at the ends of the meanders for ensuring maximum design current intensity. A comparison between FIGS. 2 and 3 immediately reveals the advantage offered by the invention in regard to the length of the strip 12 which is subjected to flexural deformation.

The hollowed-out portion 39 enables the strip 12 to work under bending stress from the boundary or point of junction with the inset region 14. It has been found that a hollowed-out portion of this type does not result in excessive weakening of the base 1.

It is desirable, however, to ensure that the region 19 which extends from the actuating fork 21 to the contact 20 is as rigid as possible so as to ensure that the movements performed by the moving armature 5 are effectively transmitted to the moving contact 20. The substantial width of the region 19, its small length and insetting of said region in the fork 21 satisfy this condition.

In comparison with a conventional relay of a type equivalent to the relay described in German Pat. No. DE-OS 2,219,315, French Pat. No. FR-A 2,466,844 makes it possible to reduce by more than one-half the volume of the electromagnet while at the same time producing more than double the value of useful forces at the end of travel. However, this reduction in volume is wholly advantageous only on condition that the contact-strips can also occupy a volume which is reduced by more than half. The present invention accordingly makes it possible, not only to meet the condition just mentioned, but also to transmit to the contacts the high value of useful force at the end of travel and to satisfy the condition of flexibility of the moving strip as required by the monostable restoring action of a magnet in accordance with French Pat. No. FR-A 2,520,152.

As will readily be apparent, the invention is not limited to the example described in the foregoing with reference to the accompanying drawings. Many alternative arrangements of this example may accordingly be contemplated without thereby departing from the scope or the spirit of the invention.

From this it follows that one of the branches could be rectilinear if space is available in some cases for the sinuous path of only one branch. In such cases the rectilinear branch can be relatively narrow and the sinuous branch can have a relatively substantial width.

It would also be possible to contemplate the use of more than two branches.

The two branches may overlap at least to a partial extent when they are arranged as shown in FIG. 2. It is thus possible to solve certain problems of very limited available space in which separate and distinct regions cannot be provided for the two branches of the contact-strip.

In the example shown in the drawings, all of the regions 14 to 17, 19 of the contact-strip 12 are formed in one piece by cutting from sheet metal but a different procedure could clearly be adopted, in particular by assembling together a number of different elements.

What is claimed is:

1. A polarized electromagnetic relay provided with at least one single-break switch (30) housed within an internal space of very small volume, said switch comprising a stationary contact (31) carried by a support (22) rigidly fixed to a base (1) of the relay, and a moving contact (20) carried by one end of a flexible strip (12) which is anchored relative to the base (1) in the vicinity of the other end (14) of said strip and which is attached to an actuating member (21) in a predetermined region (17) between its anchoring location (14) and the moving contact (20), said actuating member being rigidly fixed to a moving armature (5) of the relay, wherein the contact-strip (12) is subdivided into at least two branches (15, 16) between its anchoring region (14) and its aforesaid attachment region (17), at least one branch being adapted to follow a non-rectilinear path in order to increase the flexibility of the strip between the anchoring region (14) and the attachment region (17) of said strip.

2. A relay according to claim 1, wherein the two branches (15, 16) have substantially the same mean length.

3. A relay according to claim 1, wherein the two branches (15, 16) have substantially the same width.

4. A relay according to claim 3, wherein the switch (30) is housed in one axial end portion of an excitation coil (4) of the relay.

5. A relay according to claim 4, wherein the anchoring region (14) of the strip (12) and the moving contact (20) are located substantially at two diagonally opposite points of a casing (1, 2) which has a generally parallelepipedal shape and contains the relay.

6. A relay according to claim 5, wherein the armature (5) associated with two airgap regions has a movement of translation along the axis of the coil (4), wherein the attachment region (17) between the flexible strip (12) and the actuating member (21) is located substantially in an axis (X—X) which passes through the two airgap regions in a direction parallel to the movement of translation of the armature (5).

7. A relay according to claim 6, wherein a hollowed-out portion (39) is formed in the internal face of the base (1) and communicates with a slot (34) in which is anchored the anchoring region (14) of the moving strip (12) and wherein at least one of the branches (15, 16) is partly located within said hollowed-out portion (39).

8. A relay according to claim 7, wherein the width of the flexible strip (12) between the attachment region (17) and the moving contact (20) is greater than the sum of widths of the branches (15, 16).

9. A relay according to claim 8, wherein the actuating member (21) is a fork (21) which grips the moving strip in the attachment region (17) and in the initial portion of the aforesaid region of greater width.

* * * * *